US008672036B2

(12) United States Patent
Hughes et al.

(10) Patent No.: US 8,672,036 B2
(45) Date of Patent: Mar. 18, 2014

(54) WELLBORE CIRCULATION TOOL AND METHOD

(75) Inventors: John Hughes, Calgary (CA); Ryan Dwaine Rasmussen, Calgary (CA); Delton Andrew Campbell, Calgary (CA)

(73) Assignee: Resource Well Completion Technologies Inc., Calgary (CA)

( * ) Notice: Subject to any disclaimer, the term of this patent is extended or adjusted under 35 U.S.C. 154(b) by 389 days.

(21) Appl. No.: 13/180,354

(22) Filed: Jul. 11, 2011

(65) Prior Publication Data

US 2013/0014956 A1 Jan. 17, 2013

(51) Int. Cl.
*E21B 34/06* (2006.01)
*E21B 34/12* (2006.01)

(52) U.S. Cl.
USPC ..... 166/332.2; 166/331; 166/332.1; 166/373

(58) Field of Classification Search
USPC ..... 166/188, 331, 373, 332.1, 332.2, 334.4, 166/319
See application file for complete search history.

(56) References Cited

U.S. PATENT DOCUMENTS

| | | | | |
|---|---|---|---|---|
| 2,988,323 | A * | 6/1961 | Conrad | 251/347 |
| 3,760,878 | A | 9/1973 | Peevey | |
| 5,782,306 | A | 7/1998 | Serafin | |
| 6,776,239 | B2 | 8/2004 | Eslinger et al. | |
| 6,889,771 | B1 | 5/2005 | Leising et al. | |
| 7,011,157 | B2 | 3/2006 | Costley et al. | |
| 7,926,574 | B2 | 4/2011 | Mondelli et al. | |
| 2009/0044944 | A1 | 2/2009 | Murray et al. | |
| 2010/0263873 | A1 | 10/2010 | Turner et al. | |

* cited by examiner

*Primary Examiner* — Brad Harcourt
(74) *Attorney, Agent, or Firm* — McDonnell Boehnen Hulbert & Berghoff LLP

(57) ABSTRACT

A circulation valve includes: an outer tubular sleeve telescopically mounted at its end over a tubular mandrel; a fluid passage between sleeve and the mandrel, the fluid passage providing fluid communication between the inner bore of the valve and its outer surface; a dual knife seal assembly to control flow out of the fluid flow path through the fluid passage, the dual knife seal assembly including a first annular knife seal edge and land that seal up when the sleeve and mandrel are in a fully axially compressed position and a second annular knife seal edge and land that seal up when the sleeve and mandrel are pulled into a fully in tension position; and, a J-slot position indexing mechanism including a slot and a key to guide movement of the sleeve and the mandrel between the fully in tension position and the fully compressed position. The circulation valve is employed in a wellbore treatment assembly and methods.

18 Claims, 7 Drawing Sheets

WELLBORE CIRCULATION TOOL AND METHOD

FIELD

The invention relates to a method and apparatus for wellbore circulation operations and, in particular, for selectively opening access between a wellbore tubing string inner diameter and an annulus about the string for circulation of fluids.

BACKGROUND

It is common during wellbore operations to circulate fluids downhole. Sometimes fluid circulation is conducted for lubrication or for wellbore treatments, such as cleaning and stimulation, including fracturing.

Wellbore strings are sometimes employed to convey fluids downhole. For example, connected tubulars or continuous strings such as coiled tubing may be employed to form conduits that may be run into a well. Fluids may be conveyed through the inner bore of the strings from surface to a selected point in the well. Ports and valves may be employed to permit selective access between a wellbore tubing string inner diameter and an annulus about the string.

In some embodiments, packers may be employed in association with the string to permit focused delivery of fluids. For example, FIG. 1A shows a prior art straddle packer 10 that is deployed on string 11, in this case of coiled tubing, including attached or integral thereto a tubular body 12 with a port 14 through its wall. Fluid may be delivered, arrows F1, from the tube inner diameter 12*a*, through the port, to the annulus 16 between the tube's outer surface 12*b* and the wellbore wall 18. An annular packer 20 encircles the tube on one side of the port and another annular packer 22 encircles the tube on the opposite side of the port. The packers, therefore, straddle the port and are configured such that together they ensure that any fluid exiting the port is maintained in the area between the packers.

The straddle packer of FIG. 1A is being employed in a standard operation of injecting fluid into a formation 23 accessed by the wellbore wall. In this case, the wellbore is lined with a liner 24 and cement 26 and the fluid passes through a hole 28, such as a perforation or port in the liner and cement before reaching the formation. In such a process, fluid in the string inner diameter 12*a*, both that from run in and newly introduced fluid from pumping, will be forced from the string into the formation. The process of forcing non-intended, residual fluids into the formation is termed bull heading and sometimes results in formation damage and is wasteful.

Another straddle packer operation is shown in FIG. 1B. FIG. 1B illustrates a process for addressing sand accumulation during straddle packer use. In particular, during use of straddle packer, sometimes sand 30 accumulates uphole of the upper packer, in this illustration packer 20. If it is desired to remove that sand, for example, when the tool becomes sanded in, fluid F2 is pumped down the annulus, past the upper packer (a downwardly facing cup seal as shown) to force the sand from above the packer, through port 14, and into string 11. This process sometimes experiences difficulties, especially if the sand is packed in around the upper packer. If the sand cannot be removed, the straddle packer may get stuck in the well. In such a situation, the string may have to be removed from the well and a fishing operation conducted to remove the straddle packer.

SUMMARY

In accordance with a broad aspect of the present invention, there is provided a circulation valve comprising: a tubular mandrel including an inboard end, an opposite end formed for connection into a tubular string and an inner bore extending from the inboard end to the opposite end; an outer tubular sleeve including a first end, a second end, an outer surface and an inner facing surface defining an inner bore extending from the first end to the second end, the outer tubular sleeve being telescopically mounted at its second end over the inboard end of the tubular mandrel with an inner facing surface of the second end encircling an outer facing surface of the inboard end and the inner bore of the outer tubular sleeve in communication with the inner bore of the tubular mandrel such that a fluid flow path is open from the first end to the opposite end, the outer tubular sleeve being axially moveable relative to the inboard end of the tubular mandrel between a fully compressed position and a fully in tension position; a fluid passage between the inner facing surface of the second end and the outer facing surface of the inboard end opening to the outer surface of the outer tubular sleeve; a double sided knife seal assembly to control flow out of the fluid flow path to the fluid passage, the double sided knife seal assembly including a first annular knife seal edge, a first annular knife seal land positioned to seal with the first annular knife seal edge when the outer tubular sleeve and the tubular mandrel are in the fully compressed position, an opposite annular knife seal edge and an opposite annular knife seal land positioned to seal with the opposite annular knife seal edge when the outer tubular sleeve and the tubular mandrel are in the fully in tension position; and a J-slot position indexing mechanism to guide movement of the outer tubular sleeve and the tubular mandrel between the fully in tension position and the fully compressed position.

There is also provided a wellbore treatment assembly comprising: a circulation valve including: an outer tubular sleeve including a first end, a second end opposite the first end, an outer surface and an inner facing surface defining an inner bore extending from the first end to the second end; a tubular mandrel including an inboard end, an opposite end and an inner bore extending from the inboard end to the opposite end, the outer tubular sleeve being telescopically mounted at its second end over the inboard end of the tubular mandrel with an inner facing surface of the second end encircling an outer facing surface of the inboard end and the inner bore of the outer tubular sleeve in communication with the inner bore of the tubular mandrel such that a fluid flow path is open from the first end to the opposite end, the outer tubular sleeve being axially moveable relative to the inboard end of the tubular mandrel between a fully compressed position and a fully in tension position; a fluid passage between the inner facing surface of the second end and the outer facing surface of the inboard end, the fluid passage providing fluid communication between the fluid flow path and the outer surface of the outer tubular sleeve; a dual knife seal assembly to control flow out of the fluid flow path through the fluid passage, the dual knife seal assembly including a first annular knife seal edge, a first annular knife seal land positioned to seal with the first annular knife seal edge when the outer tubular sleeve and the tubular mandrel are in the fully compressed position, an opposite annular knife seal edge and an opposite annular knife seal land positioned to seal with the opposite annular knife seal edge when the outer tubular sleeve and the tubular mandrel are in the fully in tension position; and, a J-slot position indexing mechanism including a slot and a key to guide movement of the outer tubular sleeve and the tubular mandrel between the fully in tension position and the fully compressed position; a string manipulatable from surface having an inner diameter for providing fluid flow therethrough, into which the fluid flow path of the circulation valve is connected; and a straddle packer carried on the string adjacent the circulation valve.

Also provided is a method for circulating fluid in a wellbore, the method comprising: running a tubing string with a valve installed therein into a desired position in a wellbore, the valve including a tubular mandrel including an inboard end, an opposite end formed for connection into a tubular string and an inner bore extending from the inboard end to the opposite end; an outer tubular sleeve including a first end, a second end, an outer surface and an inner facing surface defining an inner bore extending from the first end to the second end, the outer tubular sleeve being telescopically mounted at its second end over the inboard end of the tubular mandrel with an inner facing surface of the second end encircling an outer facing surface of the inboard end and the inner bore of the outer tubular sleeve in communication with the inner bore of the tubular mandrel such that a fluid flow path is open from the first end to the opposite end, the outer tubular sleeve being axially moveable relative to the inboard end of the tubular mandrel between a fully compressed position and a fully in tension position; a fluid passage between the inner facing surface of the second end and the outer facing surface of the inboard end opening to the outer surface of the outer tubular sleeve; a pair of knife seals to control flow out of the fluid flow path to the fluid passage, the pair of knife seals including a first annular knife seal edge, a first annular knife seal land positioned to seal with the first annular knife seal edge when the outer tubular sleeve and the tubular mandrel are in the fully compressed position, an opposite annular knife seal edge and an opposite annular knife seal land positioned to seal with the opposite annular knife seal edge when the outer tubular sleeve and the tubular mandrel are in the fully in tension position; and, a J-slot position indexing mechanism to guide movement of the outer tubular sleeve and the tubular mandrel between the fully in tension position and the fully compressed position; applying an axial force on the valve by manipulation of the tubing string to move the outer tubular sleeve axially relative to the tubular mandrel, guided by the J-slot position indexing mechanism, to an open position wherein the valve is between the fully compressed position and the fully in tension position; and, pumping fluid into the string to pass out through the valve.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIGS. 3 to 6 is a series of drawings of a circulation valve and its J-slot and key arrangement showing the various operational positions thereof. In particular.

DETAILED DESCRIPTION

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, from time to time, the same number is used to reference similar, but not necessarily identical, parts.

A circulation valve and methods for circulating fluids in a wellbore have been invented.

Figure 1A:
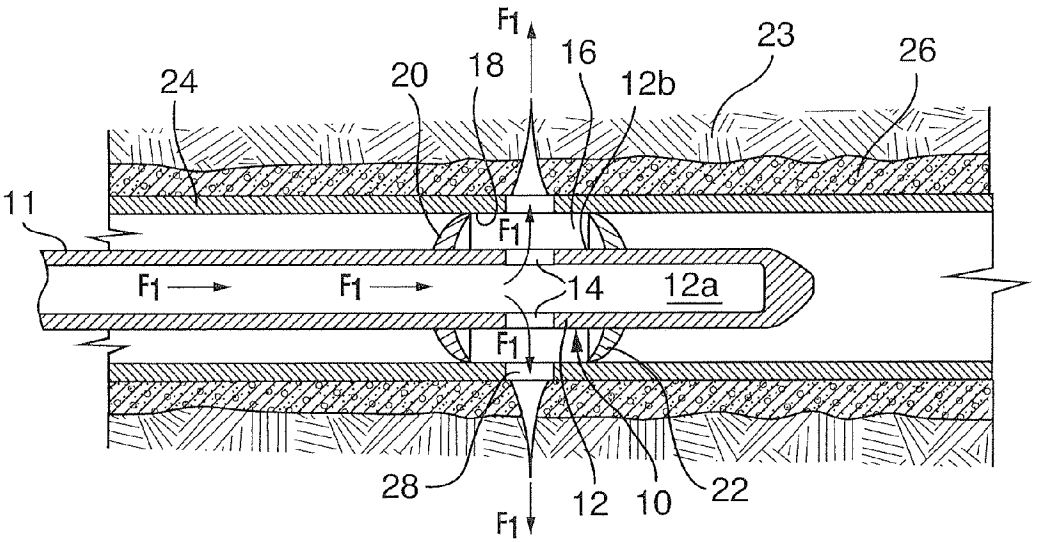
FIG. 1A PRIOR ART
FIG. 1A is a schematic showing a prior art straddle packer tool in operation in a well.
Figure 1B:
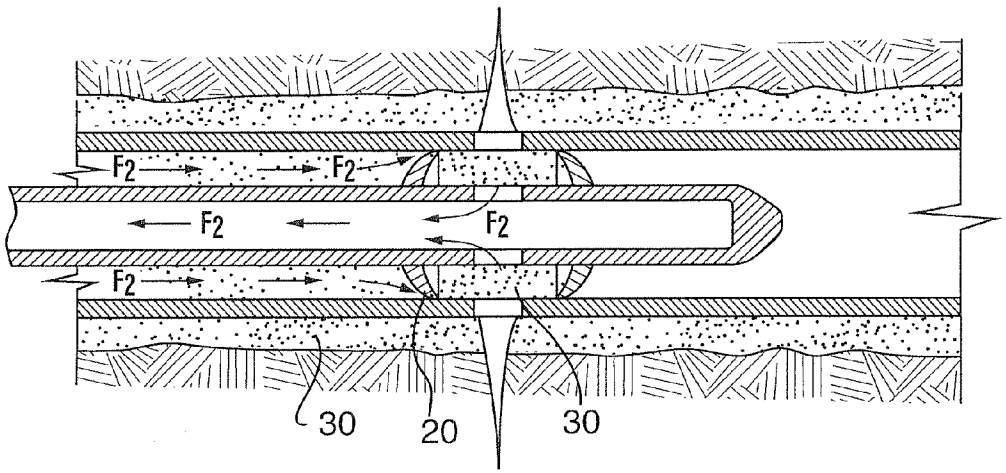
FIG. 1B PRIOR ART
FIG. 1B is a schematic showing a prior art straddle packer tool in operation in a well.
Figure 2:
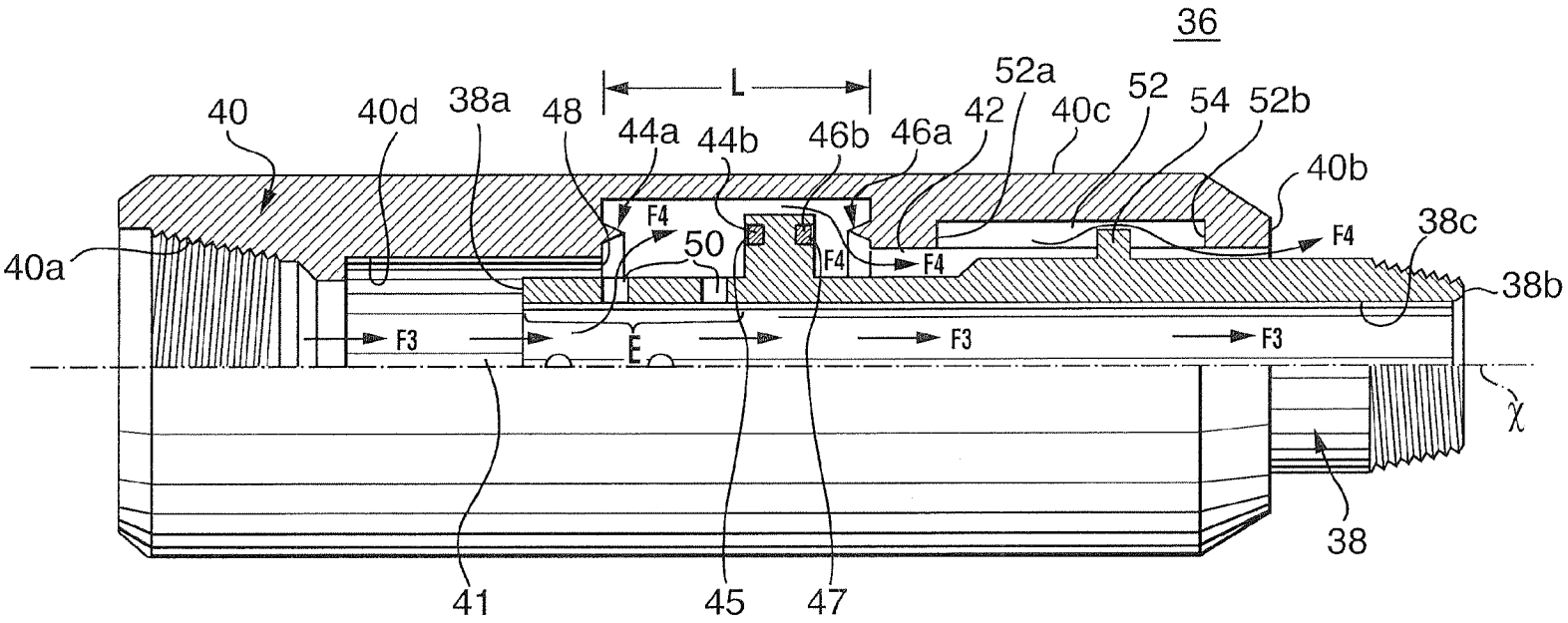
FIG. 2 is a quarter sectional view along a circulation valve.

With reference to FIG. 2, one embodiment, of a valve 36 is shown. The valve includes a tubular mandrel. 38 including an inboard end 38*a*, an opposite end 38*b* formed for connection into a tubular string and an inner facing surface 38*c* defining an inner bore extending from the inboard end to the opposite end; an outer tubular sleeve 40 including a first end 40*a* formed for connection into a tubular string, a second end 40*b*, an outer surface 40*c* and an inner facing surface 40*d* defining an inner bore extending from the first end to the second end, the outer tubular sleeve 40 being telescopically mounted at its second end over the inboard end 38*a* of the tubular mandrel with inner facing surface 40*d* of the second end encircling an outer facing surface 38*d* of the inboard end and the inner bore of outer tubular sleeve 40 in communication with inner bore 38*c* of the tubular mandrel such that a main bore 41 forming a fluid flow path (arrows F3) is open from the first end to the opposite end along axis x. Outer tubular sleeve 40 is axially moveable relative to the inboard end of the tubular mandrel between a fully compressed position and a fully in tension position.

A fluid passage 42 extends between inner facing surface 40*d* at the second end and the outer facing surface of the tubular mandrel at its inboard end 38*a*. The fluid passage 42 opens to outer surface 40*c* of the outer tubular sleeve, such that fluid can flow (arrows F4) from the main bore to outer surface 40*c*. A double sided knife seal assembly is positioned in fluid passage 42 to control flow out of the main bore through the fluid passage, the double sided knife seal assembly includes a first knife seal including: first annular knife seal edge 44*a*, a first annular knife seal land 44*b* positioned to seal with the first annular knife seal edge when the outer tubular sleeve 40 and the tubular mandrel 38 are in the fully compressed position; and an opposite knife seal including an annular knife seal edge 46*a* and an opposite annular knife seal land 46*b* positioned to seal with the opposite annular knife seal edge when the outer tubular sleeve 40 and the tubular mandrel 38 are in the fully in tension position. In FIG. 2, the valve is shown neither fully compressed nor fully in tension such that neither one of the pairs of edges and lands 44*a/b* or 46*a/b* are in a sealing position. In particular, the outer sleeve and tubular mandrel 38 are in an intermediate position between the fully compressed and the fully in tension positions. As such fluid can flow, as shown, from inner bore 41 past both the first knife seal 44*a/b* and the opposite knife seal 46*a/b*, through passage 42 and out of the valve.

The valve can be incorporated in a string by connection of string components at ends 40*a* and 38*b*. Ends 38*b*, 40*a* may be formed for connection into a string in various ways. For example, they can be threaded, as shown. Alternately, the ends may have other forms or structures to permit alternate forms of connection.

When valve 36 is connected into a string, the valve is placed in communication with the bore of the string such that fluids passing through the string enter bore 41 and can pass therethrough to a string component connected below or can pass through passage 42 if neither seal 44*a/b* nor seal 46*a/b* are in a sealing position. The valve allows the passage of fluid therethrough to a position in the string below the valve and, when open, allows communication with the annulus about the tool, which is the area open to outer surface 40*c*. The communication between the annulus and bore 41 is controllable based on the relative axial position of sleeve 40 and mandrel 38 which can be achieved by forcing sleeve 40 and mandrel 38 into maximum overlapping relation (placing the valve into the fully compressed position) or by pulling the sleeve and the mandrel apart and into a minimum overlapping condition (placing the valve in tension).

The force to achieve compression may be as a result of pushing one of the parts 40/38 toward the other of the parts, while the other part is held stationary. Of course, the other part may also have a pushing force applied thereto, but as the valve is intended for downhole use, routinely force is applied from surface by manipulation of the tubing string into which the valve is connected, while the lower end of the string is held steady. For example, if valve 36 is installed with end 40*a* connected to a tubing string extending uphole toward surface, force can be applied by lowering the string. For example, the valve can be compressed by actively pushing on the tubing string attached at end 40*a* or by placing weight on the end 40*a* by slacking off tension in the string.

Likewise, the force to achieve tension may be generated by pulling one of the parts 40/38 away from the other of the parts, while the other part is held stationary. For example, force can be applied by raising the string to which end 40*a* is connected, while end 38*b* is held stationary.

A valve with dual seals, one closeable when the valve is placed in tension and the other closeable when the valve is placed in compression, permits many options for operation including to facilitate most effective circulation when being run in and tripped out, to permit hole cleaning when needed and to permit proper operation even when the tool is being effected by substantially uncontrollable tensile and compressive forces. The various modes of operation may be better understood by reference to the methods described herein below.

Figure 3A:
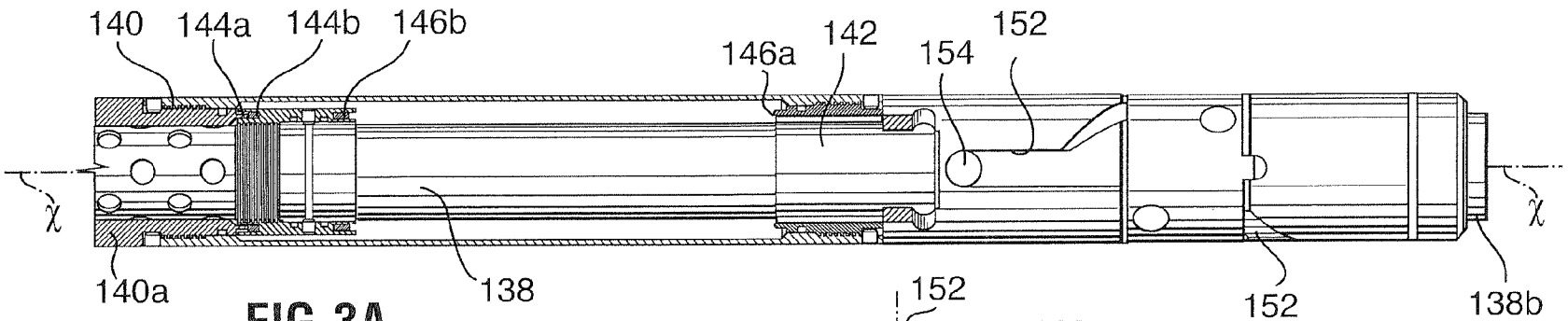
FIGS. 3A, 4A, 5A and 6A are partially cut away views of a circulation valve sub in a fully compressed closed position, a fully tensioned closed position, an intermediate, compressed open position and an intermediate, tensioned open position, respectively.

A fluid passage 42 is present between inner facing surface 40*d* of the sleeve at the second end and the outer facing surface of the tubular mandrel at its inboard end 38*a*. The fluid passage 42 opens to outer surface 40*c* of the outer tubular sleeve, such that fluid can flow (arrows F4) from the main bore to outer surface 40*c*, which as noted above is open to the annulus about the tool. In the illustrated embodiment of FIG. 2, fluid passage 42 extends along the annular gap between sleeve 40 and mandrel 38 and opens at the very end of sleeve 40. It is to be understood, however, that a port can be provided, if desired, through sleeve 40 at any point after seals 44*a/b* and 46*a/b*. This option is illustrated in FIG. 3. In other words, the outlet of passage 42 can be a port through the sleeve or the interface gap between sleeve 40 and mandrel 38, provided that both seals 44*a/b* and 46*a/b* are positioned between the outlet of the passage and bore 41.

In the illustrated embodiment, the annular gap forming passage 42 is formed an enlargement of the inner diameter along a region L of inner facing surface 40*d* of the sleeve such that it is larger than the outer facing surface of the tubular mandrel. In the illustrated embodiment, a portion of the inner facing surface adjacent end 40*a* has a smaller diameter and a shoulder 48 is formed as the diameter increases and tubular mandrel 38 includes a tubular extension E at end 38*a* that extends beyond the enlarged diameter region L in sleeve 40 to fit closely into the small diameter region between shoulder 48 and end 40*a* of sleeve 40. The residence of extension E in the small diameter region, where the parts closely fit together, enhances resistance to lateral flexing by holding mandrel 38 coaxial with sleeve 40. To permit fluid access between bore 41 and passage 42, one or more ports 50 extend through the wall of the extension.

While flow is shown outwardly through passage it is to be understood that flow can be reversed to also flow in through passage from outer surface 40*c* to bore 41, as desired. There is no one-way flow restrictor in the passage and, therefore, fluid can flow in either direction depending on fluid pressure differentials.

Double-sided knife seal assembly, including seals 44*a*/44*b* and 46*a*/46*b*, are positioned in fluid passage 42 and controls flow out of main bore 41 through the fluid passage. If either knife seal is closed, with the knife seal edge 44*a*, 46*a* sealed against its respective knife seal land 44*b*, 46*b*, fluid flow through passage 42 from bore 41 to outer surface 40*c* is stopped. First knife seal 44*a*/44*b* is closed when the outer tubular sleeve 40 and the tubular mandrel 38 are in the fully compressed position and opposite knife seal, including annular knife seal edge 46*a* and annular knife seal land 46*b*, is closed when the outer tubular sleeve 40 and the tubular mandrel 38 are in the fully in tension position. When the valve's sleeve and tubular mandrel are neither fully compressed nor fully in tension, and therefore in an intermediate position, fluid can flow through passage 42 past both the seals between bore 41 and annulus open to surface 40*c*.

The seals therefore each are positioned to have their parts (knife and land) come together when the sleeve 40 and tubular member 38 are axially moved into the appropriate position (either fully compressed or fully in tension). For example, one of each of the knife edge and the land are carried on the sleeve and the other is carried on the mandrel. In FIG. 2, the knife edges 44*a*, 46*a* are carried on the sleeve, while the lands 44*b*, 46*b* are carried on the mandrel. Of course, the relative positions can vary for example both edges can be carried on the mandrel while the lands are carried on the sleeve or one edge could be on each of the mandrel and the sleeve and their respective lands positioned on the sleeve and mandrel.

A stop wall may be provided to alleviate the seals from being subjected to all of the tension and compression loads. For example, there may be a shoulder on each seal land that acts against a stop adjacent each edge to limit the advancement of the edge into its land and to transfer the load into the body of the valve.

The lands 44*b*, 46*b* may be formed of resilient material and may be relatively softer than the material forming edges 44*a*,

46*a* such that a resilient, deformation effect occurs when the edge comes into contact with the land to facilitate sealing therebetween. The lands may, for example, be formed of a ring-shaped elastomeric material. The lands may each be mounted in a gland 45, 47 formed in more durable material such that they are protected from extrusion, etc. The gland may be formed to have a depth equal to or greater than the depth of its land such that the material of the land remains flush with or recessed into the gland. As such, the land materials are protected against direct erosive flows. Each edge may be tapered toward its free end such that the edge and the sealing interaction is less adversely affected by any debris such as sand which may be found between the parts. The interaction of the knife edge and land involves substantially minimum frictional interaction, and possibly may eliminate seal friction when opening and closing. This allows the valve to be used without the need for a drag assembly on the string.

The lands and edges are each annular such that they can operate effectively even if the sleeve 40 and mandrel 38 rotate relative to each other. For example, as will be described in greater detail below, the valve can operate with the sleeve and the mandrel capable of both rotational and axial relative movement therebetween. As such, the reduced frictional effect becomes of greater importance. In addition, the lands and edges may be positioned to extend substantially orthogonally relative to axis x, such that they can seat up regardless of the relative rotational position of the sleeve and the mandrel.

The outer tubular sleeve 40 is telescopically mounted at its second end over the inboard end 38*a* of the tubular mandrel and the parts are intended to remain as such during operation such that they cannot fully separate. However, as noted, the outer tubular sleeve 40 is axially moveable relative to the inboard end of the tubular mandrel between the fully compressed position and the fully in tension position. In these positions, at least the knife seals seat to limit further compression or extension of the sleeve and the mandrel.

A J-slot position indexing mechanism is employed to direct the movement of the sleeve and the tubular mandrel axially between the fully compressed and fully in tension closed positions and the intermediate position, where the valve is open to annular flow. The position indexing mechanism may, for example, include a slot 52 and a key 54. The slot and key may be positioned between the sleeve and the mandrel, for example in the gap, to guide the axial movement between the sleeve and the mandrel. For example, the axial length of the slot between its ends 52*a*, 52*b* and the relative position of the key may be selected to allow sufficient axial movement of the sleeve and the mandrel to allow the seals to seat. While the slot axial length may be selected to limit penetration of the edge of the seal into its land, most likely that limitation will be achieved by stops, as described above. The slot can further be laid out to permit axial movement of the sleeve and the tubular member to be positively stopped in the intermediate position, as for example by forming the slot as a J-type slot.

For example, with reference to FIGS. 3 to 6, a valve is shown including a sleeve 140 and a tubular mandrel 138. The sleeve and the tubular member are telescopically mounted together, such that they can be (i) compressed to drive the tubular mandrel into a fully compressed position in the sleeve (FIG. 3) or (ii) pulled apart to place the parts into a fully in tension position (FIG. 4), wherein mandrel 138 is pulled out as much as possible from sleeve 140.

The valve includes a first knife seal including a first knife edge 144*a* and a first knife seal land 144*b* which comes together to seal against fluid flow out of the bore 141 through passage 142 when the valve is in the fully compressed position. The valve further includes an opposite knife seal including a knife edge 146*a* and knife seal land 146*b* that comes together to seal flow through the passage when sleeve 140 and mandrel 138 are in the fully in tension position (FIG. 4).

Figure 3B:
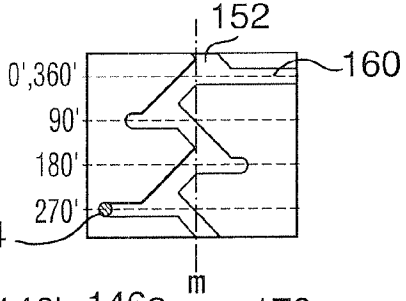
FIGS. 3B, 4B, 5B and 6B are layouts of J-slot geometry and key positions corresponding to the valve positions of FIGS. 3A, 4A, 5A and 6A, respectively.
Figure 4A:
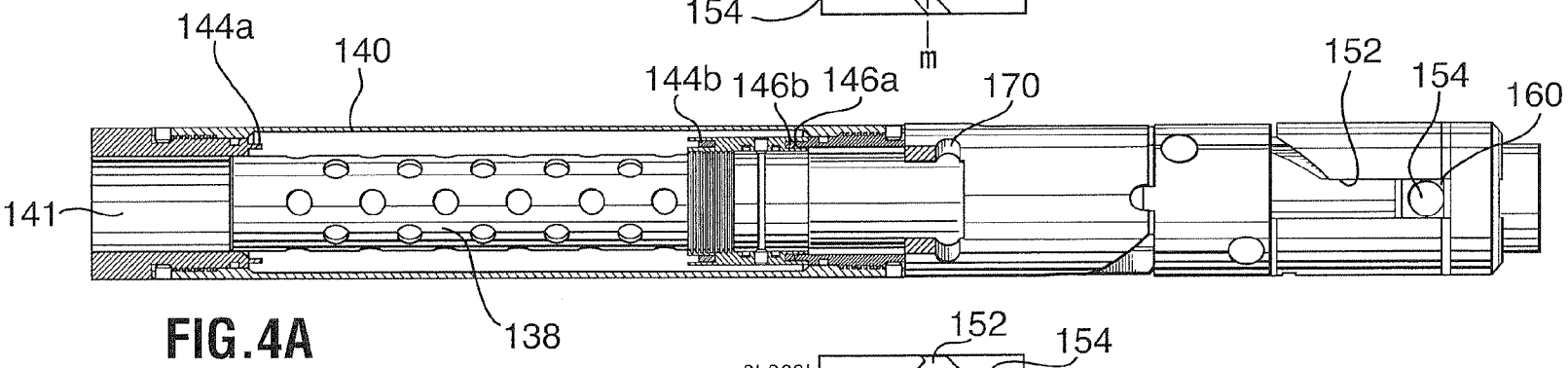
Figure 4B:
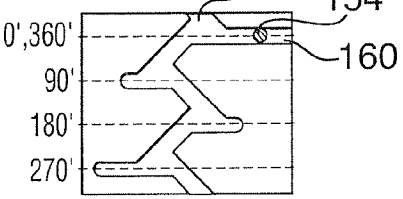
Figure 5A:
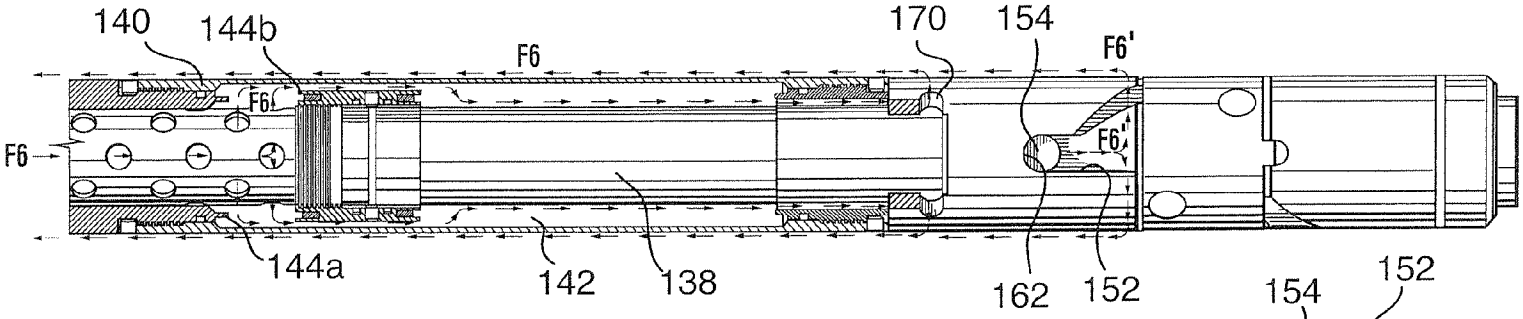
Figure 5B:
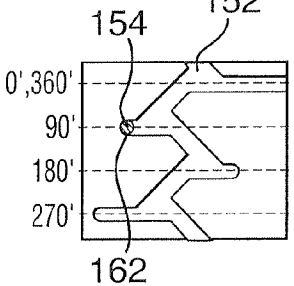
Figure 6A:
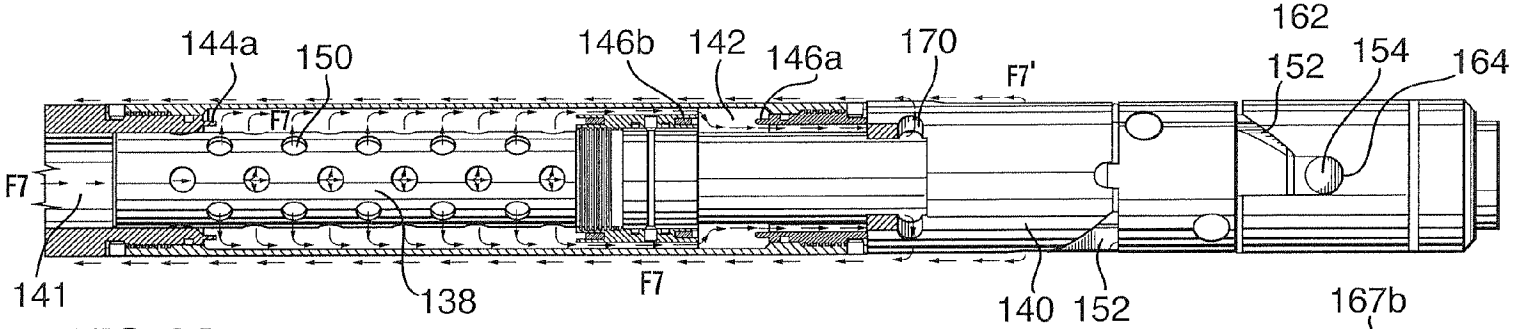
Figure 6B:
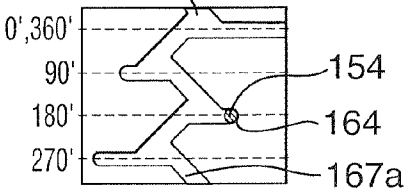

The valve includes a continuous J-slot including a slot 152 and a key 154 that provides positional indexing of the sleeve and the mandrel. The J-slot is defined in the sleeve, while the key projects from tubular member, but this orientation can be reversed if desired. The key is sometimes termed a guide pin or J-pin since it rides along within the J-slot and guides relative movement of sleeve 140 and mandrel 138. The slot geometry is shown in FIG. 3B and the movement of key 154 through slot 152 can be understood by reference to FIGS. 3B, 4B, 5B and 6B, in relation to the corresponding positions of sleeve 140 and mandrel 138 in FIGS. 3A, 4A, 5A and 6A, respectively. The key reacts with the side and end walls of J-slot 152 to provide a guiding function to move sleeve axially and rotationally relative to mandrel and permits the sleeve and the mandrel to be indexed into the fully compressed and the fully in tension positions and also positively into at least one intermediate position. While the slot geometry can vary, in this illustrated embodiment, the J-slot includes four end stop walls and adjoining angled slot sections therebetween. The four end stop walls include: end wall 160, end wall 162, end wall 164 and end wall 166. Each end wall has an angled slot section extending away toward the next end wall: angled slot section 161 leads from end wall 160 to end wall 162; angled slot section 163 leads from end wall 162 to end wall 164; angled slot section 165 leads from end wall 164 to end wall 166; and, bearing in mind that the J-slot is continuous and therefore extends about the circumference of the tool, angled slot section 167*a*, b leads from end wall 166 back to end wall 160. The slot geometry allows the sleeve and the tubular member to be moved axially according to the linear spacing between the various end walls. The angled slot sections convert axial movement of the sleeve and the tubular member to be converted into rotational movement to move the sleeve from end wall to end wall along the slot and therefore from axial extended position to axial extended position defined by the end walls. In particular, any pushing or pulling movement of the valve acting axially through ends 140*a*, 138*b* will cause key 154 to land against an end wall in the slot. Thereafter, any pushing or pulling movement in an opposite direction causes key to move axially away from the previous end wall and engage an axially aligned angled slot section. As the angled slot section is contacted by key 154, an indexing rotation will be applied to the sleeve or the tubular mandrel, depending on which one is more free to rotate relative to the other, and the key will move until stopped against the next end wall in the slot. The key can only advance to the next position, if the pushing or pulling movement is again reversed. The angled sections are formed such that the key is always forced to move in a predefined path, such that reverse movement cannot be readily achieved. In the illustrated embodiment, the end walls are separated by 90° and so the parts move about 360° when passing from a starting end wall position, through all the other positions and back to that position.

Since the position indexing mechanism of the valve operates by converting axial movement to rotational movement, a swivel may be employed to permit relative rotational movement. In the illustrated embodiment, mandrel 138 remains rotationally fixed, while sleeve 140 rotates thereon, as driven by the interaction of key 154 in slot 152. A swivel (not shown) is connected on the upper end of sleeve 140 to permit the rotation of the sleeve about the valve's long axis x.

In the illustration, end wall 160 is the furthest right from a midpoint m and when key 154 is stopped adjacent end wall 160, tubular mandrel 138 is at its greatest length extended out of sleeve 140 and knife edge 146*a* is sealed against land 146*b*. As such, when key 154 is at end wall 160 in the J-slot, the valve is fully in tension and closed. In this position, fluid (arrows F5) can pass through the axial bore 141 of the valve body, but cannot pass though passage 142, due to the effect of seal 146*a/b*.

End wall 166 in the illustration is the furthest left from the midpoint and when key 154 is stopped adjacent end wall 166, tubular mandrel 138 is at its greatest depth compressed into sleeve 140 and seal 144*a*/144*b* is closed. Therefore, end wall 166 offers that indexing position where the valve is fully compressed and closed.

End walls 162, 164 represent two intermediate positions where the passage 142 is open to flow therethrough. End wall 162 is left from the midpoint, but not as far left as end wall 166. End wall 162 stops the key when the sleeve and the tubular member are being compressed into greater overlapping relation and when key 154 stops at end wall 162, seal edge 144*a* will be maintained at a space from land 144*b* such that fluid passage 142 remains open and fluid can be pumped (arrows F6) between bore 141 and the annular environment about the outer surface 140*c*. End wall 164 is right of the midpoint, but not as far right as end wall 160. End wall 164 stops the key when the sleeve and the tubular member are being pulled apart by placing the tool in tension. When key 154 stops at end wall 164, seal edge 146*a* will be maintained at a space from its land 146*b* such that fluid passage 142 remains open and fluid can be pumped (arrows F7) between bore 141 and the annular environment about the outer surface 140*c*.

The provision of two intermediate positions provides flexibility for valve operations. The valve can be maintained open both when the tool is in compression and when it's in compression, conditions which in some cases may be simply an effect of other wellbore operations, such a string movement or pressure conditions.

Figure 7:
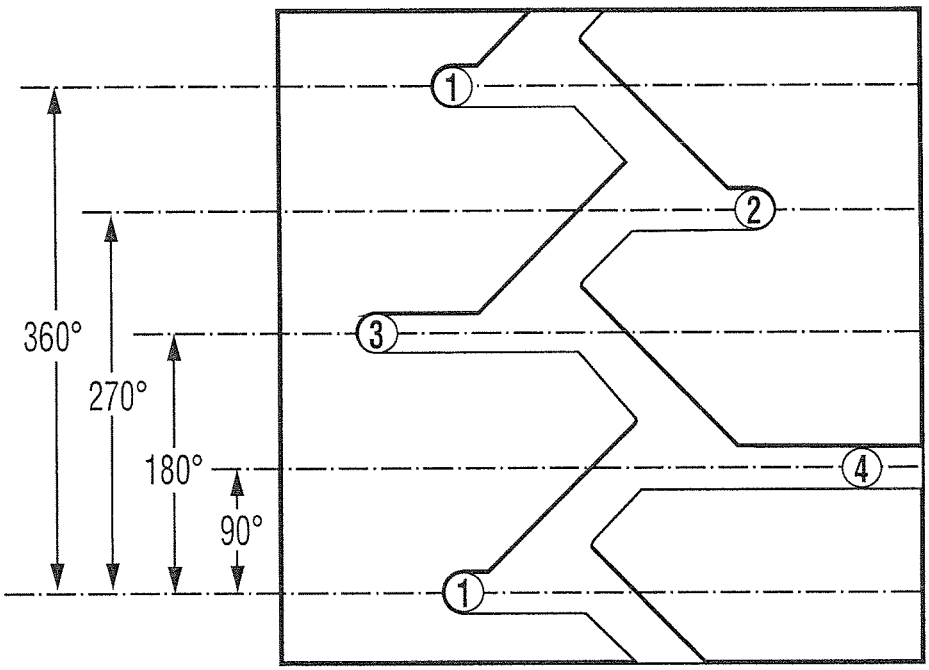
FIG. 7 is a layout of a J-slot geometry useful in the invention.

The J-slot can be set up to move the valve through the various positions in a selected, particular order. In one embodiment shown in FIG. 7, the J-slot is formed to index the valve through the following positions in order: (1) in-tension open; (2) compression open; (3) in-tension closed; and (4) compression closed. The J-slot being continuous, guides the valve back to (1) tension open after (4) compression closed. The slot stops 1 to 4 are offset 90° from each other around the circumference of the tool, but could have other spacings as desired. During normal operations, the valve might be open to the annulus prior to fracing and is closed and in-tension during fracing. With such a J-slot configuration, the valve can be moved directly from the open positions to the in-tension closed position, without passing through the compression closed position. This avoids pressure spikes and fluctuations. In particular, with the open positions ahead of the in-tension closed position, the valve can be moved directly from being open to the desired fracing in-tension closed position. Moving from a compression closed position directly to a tension closed position, may not be of interest as such movement would create a sudden decrease in pressure followed by a pressure spike, which may be misinterpreted as another downhole event.

It is noted that the valve of FIGS. 3 to 6 includes a outlet port 170 through sleeve 140 through which fluid exits from passage 142. However, in this embodiment, slot 152 also extends fully through the thickness of the wall of sleeve such that some fluid (arrows F6', F7') can also exit passage 142 through the slot. Having slot 152 open to fluid flow may permit flushing of debris therefrom to facilitate operation of the J-slot. Also, it is to be noted that while the arrows are showing the flow moving in a direction from bore 141 to the annulus, the flow can be reversed in some applications.

As is typical in wellbore tool construction, the valve parts may be produced in pieces that are connected together by threading, keying, welding, etc. For example, it is also noted that sleeve 140 is formed of a plurality of parts connected together. Also, for example, seal lands 144*b*, 146*b* are carried on a collar secured about mandrel.

Figure 8A:
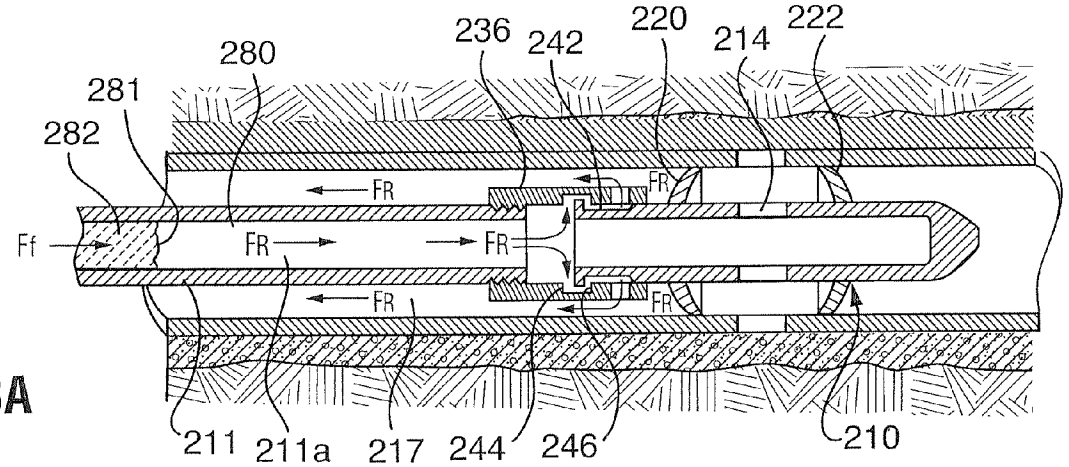
FIGS. 8A and 8B are schematics showing a circulation valve in use.

The valve can be employed in various downhole operations. In one embodiment, the valve is employed to facilitate wellbore fluid treatment operations such as those using a straddle packer. With reference to FIGS. 8, for example, a valve 236 according to one of the embodiments shown above may be employed in a wellbore treatment string including a straddle packer 210. The valve and the straddle packer are carried on a string 211. A bore 211*a* extends through the string, through the inner diameter of the valve and into the straddle packer such that fluid introduced to the string, for example at surface, can be communicated to the valve and the straddle packer.

Straddle packer 210 includes annular packer cup seals 220, 222 positioned to pressure isolate an annular section about a fluid delivery port 214. The upper packer cup 220 on the uphole side of port 214 is downwardly facing and packer 222 on the downhole side of the port is upwardly facing such that when the packer is positioned in a well, fluid introduced to annular area 216 substantially cannot leak past the packers and therefore is focused between packers 220, 222. The valve may be connected in string 211 close above the upper annular seal 220 of the packer. In this position the valve permits communication between the string's inner diameter 211 a and the annulus 217 about the string above the packer, which is that annulus that can be placed in communication with surface when the packer is in the well. Valve 236, therefore, provides for fluid communication with the annulus about the tool outside of the focused annular area 216 between packers 220, 222. Various methods can be facilitated and improved by use of the valve including the initial pumping of fluid and sand removal.

Figure 8B:
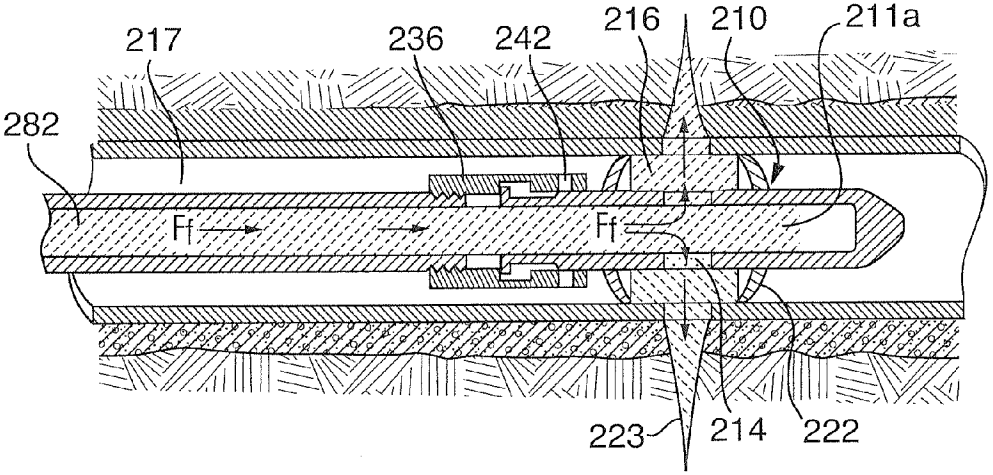

In one method, for example, valve 236 has a two-part, telescopically moveable body with two knife seals 244, 246 therebetween. Valve 236 can be opened and closed to provide fluid communication with the annulus about the valve by axial movement of the valve, to seat or unseat the knife seals through axial manipulation of the string. In particular, one knife seal closes the valve when the valve is pulled into tension and the other closes the valve when the valve is fully axially compressed (FIG. 8B). The valve is, therefore, openable by axially moving the valve into an intermediate position (FIG. 8A) between the fully in tension and fully compressed positions.

The treatment string can be run into a position in the well where it is desired to introduce a focused fluid treatment. The string pushes against the resistance of the straddle packer 210 and, therefore, valve 236 is maintained in compression and is closed during run in. It is useful to run in with the valve closed so that fluid can be communicated to the bottom hole assembly (BHA), such as packer 210, during run in. For example, in some operations it is useful during run in to communicate fluid through the annulus to the BHA, and the provision of a compression closed position for the valve, permits this circulation. In a method such as this, where the BHA includes a downwardly facing packer cup 220, run in can be facilitated by circulating fluid through the annulus and down past the packer cup to the retract it from the wellbore wall, the fluid being circulated through frac port 214 and up the string. Valve 236, being closed by compression during run in, permits this circulation through the annulus to packer cup 220.

During this process, residual fluid 280 such as drilling fluid and wellbore fluids, fills the well including string 211. Rather than bull heading the residual fluid into the formation, once the straddle packer is in a selected position, the string can be pulled up sufficiently to place the valve's telescoping parts into an intermediate position (FIG. 8A), which for greater clarity places the valve in a position such as that shown in FIG. 2 with both seals unseated and the valve's passage 242 opened. Wellbore treatment fluid 282, such as frac fluid or acid, can then be pumped (arrows Ff) through the string from surface while keeping the valve open. The wellbore treatment fluid can push the residual fluid (arrows FR) ahead of it, as shown at interface 281 and, with valve open, residual fluid can be circulated through valve 236 into annulus 217 and returned to surface. At surface, residual fluid can be collected for reuse, if desired, to avoid waste. When the wellbore treatment fluid reaches valve 236, the valve can be closed. It will be appreciated then, that valve 236 should be positioned as close as possible to the frac port 214 to minimize the amount of residual fluid between the valve and the frac port since that amount of residual fluid cannot be removed from the string.

Valve 236 is closed by pulling on the string or lowering the string to move the valve's telescoping parts out of the intermediate position and into the fully in tension or fully compressed positions such that one of the two knife seals 244, 246 seat and seal up. When the valve is closed (FIG. 8B), the wellbore treatment fluid 282 can proceed to the straddle packer 210 and be injected through port 214, into annular area 216 and into the formation 223.

During a wellbore treatment, such as a frac, the string will be generally be in tension due to pressure ballooning. The valve will therefore inherently be closed by the knife seal that seals up when the valve is pulled into tension. With some string materials, such as coil tubing, relying on a compression close position during pressured up operations may be risky, as it is difficult to ensure that compression is maintained at the bottom hole assembly. As such, the string can be pulled up to initially place the valve in an in-tension, closed position and the inherent ballooning effect ensures that the valve remains closed.

If desired, the above-noted method may employ a valve with a position indexing mechanism, such that the movement of valve's telescoping parts can be guided and the relative positions of the valve's telescoping parts can be positively selected. A valve with a position indexing mechanism providing a positive intermediate position, for example, may permit greater certainty that the valve is open and will remain open during circulation and may resist closure by forces creating generally uncontrollable tension or compression in the string, such as pressuring up of the string.

Figure 9:
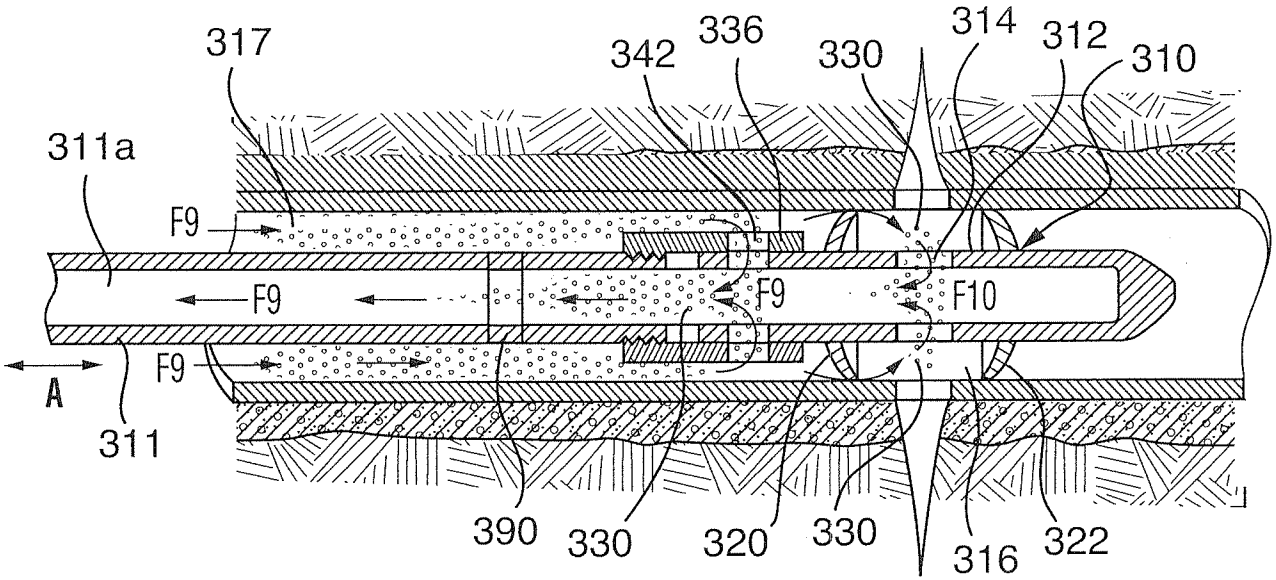
FIG. 9 is a schematic showing a circulation valve in use.

In another method, for example as shown in FIG. 9, a valve 336 similar to that of FIGS. 3 to 6 is installed in a wellbore treatment string above a straddle packer 310. Straddle packer 310 includes a pair of spaced apart annular packer cup seals 320, 322 with a fluid delivery port 314 therebetween. Port 314 provides fluid communication between inner diameter 312*a* of the straddle packer and its outer surface 312*b*. Fluid may be communicated to the inner diameter 312*a* though a bore 311 a of a string 311 on which the valve and the packer are carried or through the annulus 317 about the string and (i) through valve 336 to bore 311*a* or (ii) past upper packer 320, through port 314 to bore 311*a*.

The upper packer cup 320 on the uphole side of port 314 is downwardly facing and lower packer cup 322 on the downhole side of the port is upwardly facing such that when the straddle packer is positioned in a well, fluid introduced to annular area 316 is trapped between packers 320, 322. However, a pressure differential where pressure in annulus 317 above the upper packer is greater than that pressure between the packers in area 316, allows fluid to pass the upper packer to flow into annular area 316.

The valve is connected close above the upper annular seal 320 of the packer. In one embodiment, valve 336 can be positioned in the area where sand would accumulate above the packer. In this position, the valve permits communication between the string's inner diameter 311 a and the annulus 317 about the string above the packer in the depth of accumulated sand that might be a problem for straddle packer retrieval. Valve 336 should be positioned as close as possible above the upper packer so that the maximum amount of sand can be removed from uphole of the upper packer.

Valve 336 has a two part telescopically moveable body with two knife seals therebetween and a position indexing mechanism including a continuous J-slot. Valve 336 can be opened and closed to provide fluid communication with the annulus about the valve by axial movement of the valve, through axial manipulation of the string, which drives the telescoping parts through the positions allowed by the indexing mechanism including a fully in tension, closed position where one of the two knife seals is seated and sealed, a fully in compression, closed position where the other of the two knife seals is seated and sealed and at least one intermediate position where neither of the two knife seals is sealed and the valve is therefore open to fluid flow through passage 342.

The treatment string can be run into a position in the well where it is desired to introduce a focused fluid treatment through port 314. The valve can be placed in a particular position (open or closed), as desired, before introduction to the well. During run in, the string pushes against the resistance of the straddle packer 310 and therefore, if valve 336 is in a compressed position, it is likely to remain in that position. Generally, for example, valve may be placed in fully compressed, closed position during run in. However, if the string is reciprocated during run in, the key may have moved along the J-slot and the valve may, therefore, be in a position other than that in which it was originally set. When the treatment string is in position, therefore, the string can be pressure tested to determine if the valve is open or closed. If necessary, the string can be moved axially to actuate the valve to move to the appropriate position (open or closed). In particular, the string can be raised and/or lowered to move the key through the J-slot until the key is in a selected position in the J-slot at one of the end walls and, therefore, the valve is in a particular orientation. The straddle packer holds the string's lower end from rotating and from moving axially and some string components such as coiled tubing cannot be readily twisted. Thus, a swivel 390 may be installed to allow one part of the valve to rotate relative to the other, as driven by the interaction of the J-slot key and the J-slot. Since a knife seal is substantially frictionless, the weight and anchoring provided by the straddle packer is sufficient to hold the lower end of the string steady such that movements of the string can be adequately communicated for actuation of the valve. No drag assembly is required.

The valve can be employed for sand control. Thus, in the illustrated embodiment, the valve is initially closed and a wellbore treatment process is conducted through the straddle packer (similar to the method of FIG. 8B). With the valve closed, fluid introduced through string 311 passes through valve 336 to the straddle packer port 314. After the fluid treatment, the straddle packer is moved to another location to conduct another treatment (as in multizone treatments) or is pulled out of the hole. The in-tension knife seal allows the seal to be closed by placing in tension, such as will occur during pressurized wellbore treatments. When the pressurized treatment is concluded, the string can be pulled to move the straddle packer to the next interval. This pulling maintains the string, and therefore, the valve in tension and the valve remains closed and is ready for a next pressurized treatment at the next interval. If difficulty is encountered moving to the next interval, the valve can be opened by manipulation of the string to open the valve and circulation can be initiated to remove debris from the well.

For example, if sand 330 is accumulated on upper packer 320, the straddle packer may be immovable. Valve 336 may then be employed to remove the sand by fluid circulation. In particular, for sand removal, valve 336 is opened by axially moving the string (arrow A). Thereafter, fluid (arrows F9) may be circulated down through the annulus, which removes the accumulated sand by forcing it through the passage 342 and into the string inner diameter 311*a*. As the sand is removed down to the level of the port, some fluid (arrows F10) may also migrate past the upper packer to annular area 316 and into the inner diameter through port 314, entraining and removing the remaining sand with the flow F10. Thus, after the level of the sand has been removed to a manageable level through passage 342, the straddle packer may be moved or circulation F10 may continue to force any sand below valve 336 into string 311 through port 314.

If the well requires the removal of debris when the straddle packer is being moved, the valve could be moved through the J-slot to a tension open position, such circulation can be continued to continuously move debris from above the bottom hole assembly while pulling out up hole. If a tool became stuck during upward movement, the valve could be moved to a compression open position and the tool moved back down hole while circulating to remove debris. Effectively, the bottom hole assembly could be reciprocated up and down while circulating in an attempt to remove an obstruction.

The processes can be conducted in horizontal or vertical wellbore orientations, in cased or open wells, etc.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A circulation valve comprising:

a tubular mandrel including an inboard end, an opposite end formed for connection into a tubular string and an inner bore extending from the inboard end to the opposite end;

an outer tubular sleeve including a first end, a second end, an outer surface and an inner facing surface defining an inner bore extending from the first end to the second end, the outer tubular sleeve being telescopically mounted at its second end over the inboard end of the tubular mandrel with an inner facing surface of the second end encircling an outer facing surface of the inboard end and the inner bore of the outer tubular sleeve in communication with the inner bore of the tubular mandrel such that a fluid flow path is open from the first end to the opposite end, the outer tubular sleeve being axially moveable relative to the inboard end of the tubular mandrel between a fully compressed position and a fully in tension position;

a fluid passage between the inner facing surface of the second end and the outer facing surface of the inboard end, the fluid passage providing fluid communication between the fluid flow path and the outer surface of the outer tubular sleeve;

a dual knife seal assembly to control flow out of the fluid flow path through the fluid passage, the dual knife seal assembly including a first annular knife seal edge, a first annular knife seal land positioned to seal with the first annular knife seal edge when the outer tubular sleeve and the tubular mandrel are in the fully compressed position, an opposite annular knife seal edge and an opposite annular knife seal land positioned to seal with the opposite annular knife seal edge when the outer tubular sleeve and the tubular mandrel are in the fully in tension position; and, a J-slot position indexing mechanism including a slot and a key to guide movement of the outer tubular sleeve and the tubular mandrel between the fully in tension position and the fully compressed position.

2. The circulation valve of claim 1 wherein a long axis is defined between the inboard end and the opposite end and the knife seal edges and knife seal lands each extend orthogonally to the long axis.

3. The circulation valve of claim 1 wherein the fluid passage extends through the slot of the J-slot position indexing mechanism.

4. The circulation valve of claim 1 wherein the slot of the J-slot position indexing mechanism is continuous about the circumference of the valve.

5. The circulation valve of claim 1 wherein the J-slot position indexing mechanism allows the valve to be positioned in an in-tension open position and a compression open position between the between the fully in tension position and the fully compressed position.

6. The circulation valve of claim 5 wherein the J-slot position indexing mechanism allows the valve to be moved directly from the compression open position to the fully in tension position.

7. A wellbore treatment assembly comprising:

a circulation valve including: an outer tubular sleeve including a first end, a second end opposite the first end, an outer surface and an inner facing surface defining an inner bore extending from the first end to the second end; a tubular mandrel including an inboard end, an opposite end and an inner bore extending from the inboard end to the opposite end, the outer tubular sleeve being telescopically mounted at its second end over the inboard end of the tubular mandrel with an inner facing surface of the second end encircling an outer facing surface of the inboard end and the inner bore of the outer tubular sleeve in communication with the inner bore of the tubular mandrel such that a fluid flow path is open from the first end to the opposite end, the outer tubular sleeve being axially moveable relative to the inboard end of the tubular mandrel between a fully compressed position and a fully in tension position; a fluid passage between the inner facing surface of the second end and the outer facing surface of the inboard end, the fluid passage providing fluid communication between the fluid flow path and the outer surface of the outer tubular sleeve; a dual knife seal assembly to control flow out of the fluid flow path through the fluid passage, the dual knife seal assembly including a first annular knife seal edge, a first annular knife seal land positioned to seal with the first annular knife seal edge when the outer tubular sleeve and the tubular mandrel are in the fully compressed position, an opposite annular knife seal edge and an opposite annular knife seal land positioned to seal with the opposite annular knife seal edge when the outer tubular sleeve and the tubular mandrel are in the fully in tension position; and, a J-slot position indexing mechanism including a slot and a key to guide movement of the outer tubular sleeve and the tubular mandrel between the fully in tension position and the fully compressed position;

a string manipulatable from surface having an inner diameter for providing fluid flow therethrough, into which the fluid flow path of the circulation valve is connected; and a straddle packer carried on the string adjacent the circulation valve.

8. The wellbore treatment assembly of claim 7 wherein the straddle packer includes an upper packer cup seal and a lower packer cup seal.

9. The wellbore treatment assembly of claim 7 further comprising a swivel between the circulation valve and the string to permit independent rotation of the circulation valve relative to the string.

10. A method for circulating fluid in a wellbore, the method comprising:

running a tubing string with a valve installed therein into a desired position in a wellbore, the valve including a tubular mandrel including an inboard end, an opposite end formed for connection into a tubular string and an inner bore extending from the inboard end to the opposite end; an outer tubular sleeve including a first end, a second end, an outer surface and an inner facing surface defining an inner bore extending from the first end to the second end, the outer tubular sleeve being telescopically mounted at its second end over the inboard end of the tubular mandrel with an inner facing surface of the second end encircling an outer facing surface of the inboard end and the inner bore of the outer tubular sleeve in communication with the inner bore of the tubular mandrel such that a fluid flow path is open from the first end to the opposite end, the outer tubular sleeve being axially moveable relative to the inboard end of the tubular mandrel between a fully compressed position and a fully in tension position; a fluid passage between the inner facing surface of the second end and the outer facing surface of the inboard end, the fluid passage providing fluid communication between the fluid flow path and the outer surface of the outer tubular sleeve; a pair of knife seals to control flow out of the fluid flow path through the fluid passage, the pair of knife seals including a first annular knife seal edge, a first annular knife seal land positioned to seal with the first annular knife seal edge when the outer tubular sleeve and the tubular mandrel are in the fully compressed position, an opposite annular knife seal edge and an opposite annular knife seal land positioned to seal with the opposite annular knife seal edge when the outer tubular sleeve and the tubular mandrel are in the fully in tension position; and, a J-slot position indexing mechanism to guide movement of the outer tubular sleeve and the tubular mandrel between the fully in tension position and the fully compressed position;

applying an axial force on the valve by manipulation of the tubing string to move the outer tubular sleeve axially relative to the tubular mandrel, guided by the J-slot position indexing mechanism, to an open position wherein the valve is between the fully compressed position and the fully in tension position; and, circulating fluid through the fluid passage of the valve.

11. The method of claim 10 wherein applying an axial force includes raising the string from surface.

12. The method of claim 10 wherein applying an axial force includes lowering the string from surface.

13. The method of claim 10 wherein the tubing string further carries a bottom hole assembly and the valve is installed uphole of a bottom hole assembly.

14. The method of claim 13 wherein circulating fluid includes removing sand from uphole of the bottom hole assembly.

15. The method of claim 14 wherein removing sand includes circulating fluid from surface through an annulus between the tubing string and a wall of the wellbore to the valve to force sand through the valve, into the string and toward surface.

16. The method of claim 13 further comprising after circulating fluid: injecting wellbore treatment fluid through the string and out into the wellbore through the bottom hole assembly and circulating fluid includes pushing an amount of residual fluid ahead of the wellbore treatment fluid out through the valve; and applying an axial force on the valve by manipulation of the tubing string close the valve when the wellbore treatment fluid reaches the valve.

17. The method of claim 10 wherein running includes circulating fluid from surface through an annulus between the tubing string and a wall of the wellbore past the valve.

18. The method of claim 10 wherein circulating fluid includes passing fluid through the J-slot indexing mechanism to remove debris.

* * * * *